US006536309B1

(12) United States Patent
Pool

(10) Patent No.: US 6,536,309 B1
(45) Date of Patent: Mar. 25, 2003

(54) BOLT AND NUT REMOVER TOOL SET

(75) Inventor: James L. Pool, deceased, late of Clarinda, IA (US), by Karan Pool, executrix

(73) Assignee: The Lisle Corporation, Clarinda, IA (US)

( * ) Notice: Subject to any disclaimer, the term of this patent is extended or adjusted under 35 U.S.C. 154(b) by 0 days.

(21) Appl. No.: 09/897,807

(22) Filed: Jun. 29, 2001

(51) Int. Cl.[7] ..... B25B 13/50
(52) U.S. Cl. ..... 81/53.2; 81/120
(58) Field of Search ..... 81/53.2, 120, 124.3

(56) References Cited

U.S. PATENT DOCUMENTS

| | | | | |
|---|---|---|---|---|
| 1,093,252 | A | | 4/1914 | Carnes |
| 1,590,200 | A | | 6/1926 | McGuckin |
| 2,538,343 | A | | 1/1951 | Van Winkle, Jr. |
| 3,161,090 | A | | 12/1964 | McLellan |
| 3,354,757 | A | | 11/1967 | Grimm et al. |
| 4,328,720 | A | | 5/1982 | Shiel |
| 4,572,035 | A | | 2/1986 | Eisenhauer |
| 4,607,547 | A | | 8/1986 | Martus |
| 4,671,141 | A | | 6/1987 | Hanson |
| 4,716,793 | A | | 1/1988 | Tauber |
| 4,805,495 | A | | 2/1989 | Tauber |
| 4,993,289 | A | | 2/1991 | Parks |
| 5,251,516 | A | | 10/1993 | Desaulniers |
| 5,301,573 | A | | 4/1994 | Weber et al. |
| 5,513,545 | A | | 5/1996 | George |
| 5,551,320 | A | | 9/1996 | Horobec et al. |
| 5,582,496 | A | | 12/1996 | Ambrico |
| 5,690,004 | A | | 11/1997 | Weber |
| 5,737,981 | A | | 4/1998 | Hildebrand |
| 5,904,076 | A | | 5/1999 | Siwy |
| 5,907,983 | A | | 6/1999 | Spirer |
| 5,974,916 | A | * | 11/1999 | Lassiter ..... 81/124.3 |
| 6,003,411 | A | | 12/1999 | Knox |
| 6,047,620 | A | | 4/2000 | Kozak et al. |

OTHER PUBLICATIONS

The Damaged Nut & Bolt Removers, Inshalla Products Inc., Tampa FL.

* cited by examiner

*Primary Examiner*—James G. Smith
(74) *Attorney, Agent, or Firm*—Banner & Witcoff, Ltd.

(57) ABSTRACT

A bolt and stud removal tool as well as a set thereof includes a body member with a throughbore having a stud engaging end and a shard receiving end. A plurality of uniformly and substantially identical teeth are defined on the inside of the throughbore at the stud engaging end, each tooth defined by converging walls to define a truncated, converging profile.

7 Claims, 2 Drawing Sheets

BOLT AND NUT REMOVER TOOL SET

BACKGROUND OF THE INVENTION

In a principal aspect, the present invention relates to a tool for removing nuts, bolts and/or studs from a work piece where the threads have been stripped, the heads have been damaged or other circumstances necessitate to use a special tool to effect removal. The invention also relates to a set of such tools, which may be used with a multiplicity of sizes of nuts, bolts and/or studs.

Often, mechanics and other skilled trades persons are faced with the need to disassemble machinery, engines or the like. When engaging in such tasks, it may be necessary to remove nuts, bolts, headed fasteners, studs and the like. Attempts at such removal may result in the stripping of the threads or head or the breaking of such a bolt or stud. For example, a bolt may have a head which enjoys a polygonal shape but that is malformed or deformed. The same may be true with respect to a threaded stud or nut. Thus, there has developed a need for tools which will facilitate removal of nuts, bolts and/or studs which have been damaged, deformed or otherwise rendered incapable of easy removal from a work piece using conventional wrenches and equivalent tools.

Various solutions have been proposed to effect removal of such bolts and studs. For example, numerous patents have issued over the years depicting tools to facilitate such removal. Included among those are McGuckin, U.S. Pat. No. 1,590,200; Hildebrand, U.S. Pat. No. 5,737,981; Horobec, U.S. Pat. No. 5,551,320; Spirer, U.S. Pat. No. 5,907,983; Siwy, U.S. Pat. No. 5,904,076; Knox et al., U.S. Pat. No. 6,003,411 and Hanson, U.S. Pat. No. 4,671,141.

Typically, tools of this nature include a bore or counterbore with various types of teeth formed inside the bore. The teeth engage over the head of a deformed bolt or over a stud, and upon rotation of the tool, the teeth grip into the stud or bolt thereby facilitating removal. Often the teeth in such tools are canted or inclined in one direction or the other to facilitate the gripping action. Of course, if the gripping action is facilitated for turning of the tool in a first sense or direction because of the canted teeth, the result of turning in the opposite direction is that the gripping is not as effective.

In most instances, tools of this nature are also very difficult to manufacture. That is, the pattern of teeth or gripping ribs or members provided in the bore of such tools is quite difficult to form particularly if the shape is complex and if the teeth are inclined in one direction or the other. As a consequence, there has remained and continues to be the need to provide a bolt and stud removal tool which is useful for both studs as well as bolts, which has application over a wide range of bolt and stud sizes, which will not strip the bolt or stud, and which may be used by rotation in any sense or direction, which is economical and otherwise easy to use.

SUMMARY OF THE INVENTION

Briefly, the present invention comprises a bolt and stud removal tool, as well as a set of such tools wherein members of the set comprise an elongate body member, symmetrical about a centerline axis with a bore or counterbore extending axially through or into the tool, said bore or counterbore including at least three internal ribs or teeth formed and arranged in an array about the axis within the bore or counterbore. The teeth each have a particular configuration; namely, the teeth are each formed of first and second side walls converging toward the axis parallel to the centerline axis and a third wall connecting the first and second walls, the third wall also being parallel to the centerline axis spaced radially from the centerline axis. Planar projections of the first and second converging walls intersect intermediate the centerline axis and the connecting third wall. Consequently, a cross-sectional profile of each of the ribs or teeth has a truncated shape with the narrow end of the truncated form facing or adjacent the centerline axis of the bore through the tool and the wide or base portion of the truncated rib or tooth spaced radially outward from the internal, connecting third wall.

The stud and bold removal tools are typically provided as a set having a series of sizes to accommodate multiple sizes of bolts and other fasteners. Each tool, preferably, includes a counterbore recess at its operative end (the end fitting over a bold or stud) to facilitate working alignment of the tool on a stud or bolt. Preferable, each tool further includes a shard gathering and retaining or receiving section distal from the operative end but adjacent to the section or part of the tool which comprises the teeth or ribs in the bore. The shard section is for receiving and holding shards that are formed during use of the tool. Preferably, the tool includes a polygonal outside surface, for example, a hexagonal shape which enables gripping and use of the tool by means of another tool such as a wrench or the like. In a preferred embodiment, six equally spaced inwardly extending ribs or teeth having the same size and shape and lying with their base on the same cylinder and of the nature described are provided for the tool. Also in a preferred embodiment, the tool includes a throughbore rather than merely a counterbore so that the end of a stud to be removed may fit entirely through the tool if necessary.

Thus, it is an object of the invention to provide an improved bolt and stud removal tool.

It is a further object of the invention to provide an improved bolt and stud removal set of tools designed for utilization with variously sized bolts and studs.

Yet another object of the invention is to provide a bolt and stud removal tool which may be rotated in either sense once positioned on a bolt or stud and having equal utility and effectiveness regardless of the sense of rotation of the tool to remove a nut, bolt or stud.

Yet another object of the invention is to provide a bolt and stud removal tool which is easy to use, and which does not tend to strip or further destroy the stud or bolt upon which it is to be used, but rather which provides a maximum torque to effect removal of the stud or bolt.

Another object of the invention is to provide a bolt and stud removal tool which may be easily manufactured utilizing conventional manufacturing techniques.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 7:
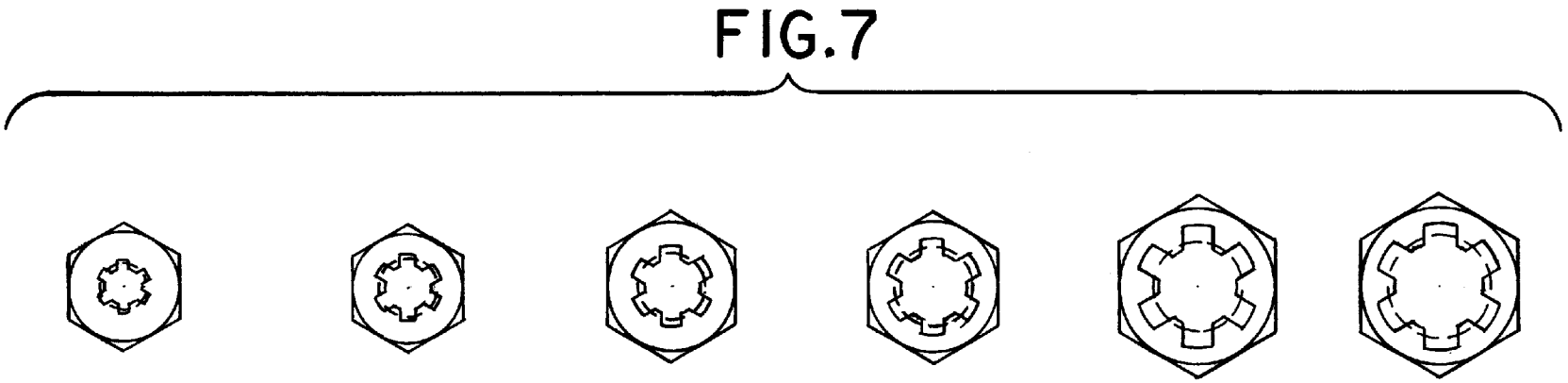
FIG. 7 is an end view of a full set of typical stud and bolt removal tools incorporating the invention as viewed from the operative end of the tool designed to engage the stud and/or bolt and wherein there is depicted in phantom a stud having a designated diameter and thread size engaged therewith.
Figure 8:
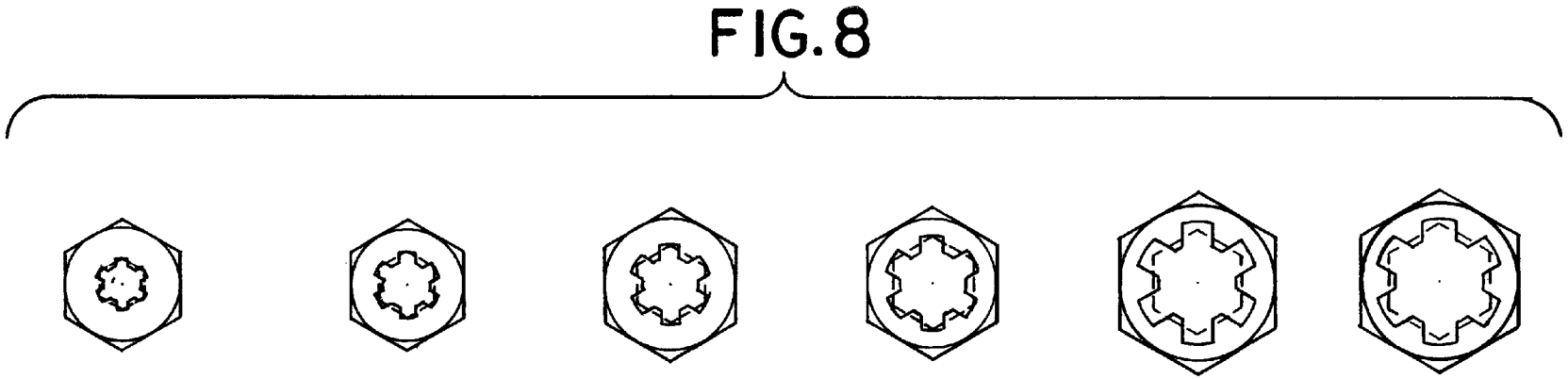
FIG. 8 is an end view of a set of bolt and stud removal tools wherein the tool is depicted in combination with associated hexagonal headed bolts in phantom with which each of the separate tools is to be utilized to effect removal.

Referring to the Figures, and in particular, FIGS. 1–6, there are depicted three examples of embodiments of the tool which when taken in groups of two or more tools of distinct size together comprise a set or subset of tools. Typically, multiple sizes of the tool are made in order to provide a set of tools of the type depicted in FIGS. 1–6. Typically, a set of six tools, as depicted in FIGS. 7 and 8, is provided in order to enable a mechanic or technician to have access to a full range of most sizes and thereby to effect removal of a stud and/or bolt regardless of the size of the stud, nut or bolt.

Referring first to FIGS. 1–6, like numbers are utilized for like component parts of the tool. Each tool includes a body member 10 with a centerline axis 12 that defines an axis of symmetry for the tool. Importantly, the cross sectional profile of the tool is preferably symmetrical with respect to the centerline axis 12. The tool includes a first or forward or fastener engagement end 14 and a back or rear end 16. The first or forward end 14 has an internal stud engaging section 18 associated therewith. Adjacent the stud engaging section 18 is a shard receiving section 20.

In a preferred embodiment, the tool includes a throughbore 22 which extends axially, entirely through the tool. However, it is possible that a counterbore extending inwardly from front end 14 may be utilized as a stud engaging section 18 with at least a portion of the shard receiving section 20. Generally, the internal diameter of the shard receiving section 20 is greater than the internal major diameter of any section or portion of the stud removal and stud engaging section 18. This is for the function and purpose of enabling the shard receiving section 20 to receive metal shards easily and thereby facilitate engagement of the tool with a stud or bolt head.

In the preferred embodiment, the shard receiving section 20 is defined by an internal cylindrical section of the throughbore 22. A connecting land or transition section 24 connects the shard receiving section 20 of throughbore 22 with the stud engaging section 18 of the throughbore 22.

The stud and bolt engaging section 18 of throughbore 22 is generally cylindrical and includes a series of ribs or inwardly projecting teeth 30 which are equally spaced around the inner periphery of the bore 22. The teeth 30 are substantially identical and all elements thereof are substantially parallel to the axis 12. The teeth 30 are uniquely shaped. Thus, each of the ribs or teeth 30 comprise a first converging wall 32 and a second converging wall 34. The walls 32, 34 of each tooth 30 both converge toward axis 12 and are, thus, not parallel to one another. They are, however, parallel to the centerline axis 12, and the walls 32, 34 define a groove between parallel, adjacent teeth 30. Each of the walls 32, 34 is connected by a third connecting wall 36. The third connecting wall 36 may be formed at a radial distance outwardly from the centerline axis 12 with an arcuate shape or it may be a flat wall 36 depending upon the broaching operation which is used to form the tool and the dies which are utilized to form the tool.

The converging walls 32, 34 converge uniformly and equally one toward the other and toward the centerline axis 12 from a common or equal radial distance from axis 12. An extension of each of the respective pairs of converging walls 32, 34 intersects a line 37 at a point intermediate the centerline axis 12 and the wall 36. The line 37 of intersection of walls 32, 34 also lies on a radius of axis 12 which passes through the midpoint of the wall 36. In other words, the teeth 30 are symmetrical and a perpendicular bisector center line extension 37 from the wall 36 passes through the centerline axis 12 with respect to all of the teeth 30.

As few as three such teeth 30 may be utilized. Preferably the teeth 30 are equally spaced one from the other. In the most preferred embodiment, six equally spaced teeth 30 are utilized. It is possible, however, to have more than six equally spaced teeth 30. Preferably, the teeth 30 are uniformly spaced about the centerline axis 12. However, if the teeth 30 are offset slightly (i.e. non-uniformly spaced about the periphery of the bore 22) with respect one to the other, the construction is still within the scope of the invention. Thus, the spacing of walls 32, 34 of distinct adjacent teeth 30, as well as the position and dimensions of adjacent teeth 30.

In a preferred embodiment, the spacing between the base of each tooth 30 is substantially equal to the width of the base of each tooth 30. Thus, referring to the figures, a maximum width 42 of the truncated shape or profile defining a tooth 30 would be substantially equal to the width 44 or extent of separation between adjacent teeth 30. Again, variances in this regard are possible. It is to be noted that the flat surface walls 32, 34 of each of the teeth 30 define a tooth profile in section wherein each face lies on a chord that does not intersect the axis 12, and each wall 32, 34 is parallel to the axis 12 and spaced slightly from the axis 12. The component parts of the rib or teeth 30 are all parallel to the axis 12 and, preferably, are not skewed relative to axis 12 in any fashion. This is a preferred embodiment of the invention, it being realized that a slight skewing of teeth 30 one way or the other relative to axis 12 may be considered to be within the scope of the invention. The lack of skewing of the teeth 30 in the bore in the axial direction is highly preferred to maintain the necessary effective depth of the stud engaging section 18. The teeth 30 will thus immediately and fully engage and cut into a fastener to be removed along a linear line of contact between tool teeth 30 and the fastener.

With respect to the forward end 14 of the stud engaging section 18, in a preferred embodiment for the tools, a short cut-out section 50 into the inner end of each of teeth 30 is provided. This enables and facilitates alignment of the tool on a stud or the head of a bolt, for example, and is preferred for each tool size.

In practice, a series of such tools is provided to enable use of the appropriate and desired size tool with any one of sized stud and/or bolt. FIGS. 7 and 8 illustrate such a series of tools. FIG. 7 depicts the various sizes of tools as they would engage with a stud wherein the dotted or phantom lines depict the preferred diametral extent of the threads of a stud associated or correlated with the tool. Table 1 sets forth the correlation between the dimensional characteristics of a set of such tools and studs as depicted in FIG. 7. The tool size correlation for hexagonal headed bolts is depicted in FIG. 8.

TABLE 1

TOOLS FIT THREAD & HEX SIZES SHOWN BELOW

| Tool Size | 1 | 2 | 3 | 4 | 5 | 6 | |
|---|---|---|---|---|---|---|---|
| Thread Size — Inch | ¼ | 5/16 | ⅜ | 7/16 | ½ | 9/16 | (FIG. 7) |
| Thread Size — Metric | 6 | 8 | 10 | — | 12 | 14 | (FIG. 7) |
| Hex Size — Inch | ¼ | 5/16 | ⅜ | 7/16 | ½ | 9/16 | (FIG. 8) |
| Hex Size — Metric | | 7.8 | 10 | — | 13 | — | (FIG. 8) |
| Tool Dimensions $R_1$* | .1000 | .1305 | .1560 | .188 | .219 | .242 | (FIG. 1A) |
| Tool Dimensions $R_2$* | .140 | .192 | .230 | .278 | .343 | .357 | (FIG. 1A) |

Figure 1:
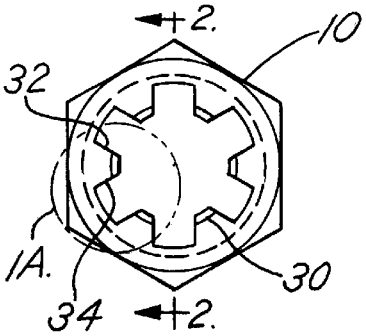
FIG. 1 is an end view of a bolt and stud removal tool of the invention as viewed from the operative end which is fitted over a stud or bolt.
Figure 2:
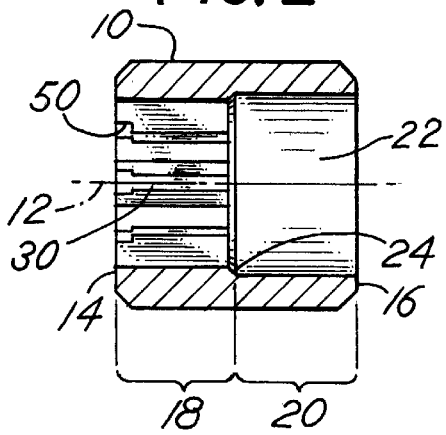
FIG. 2 is a cross sectional view of the tool of FIG. 1 taken along the line 2—2.
Figure 1A:
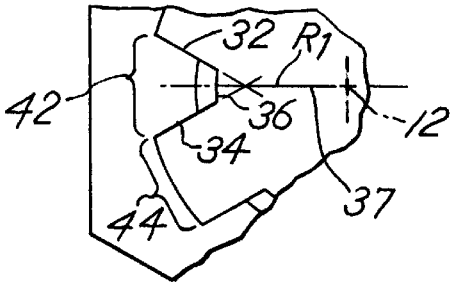
Figure 3:
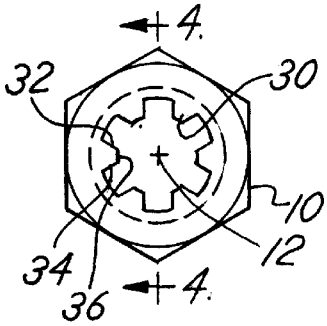
FIG. 3 is an end view of an alternative size bolt and stud removal tool incorporating the invention viewed from the operative end of the tool which is fitted over a stud and/or bolt.
Figure 4:
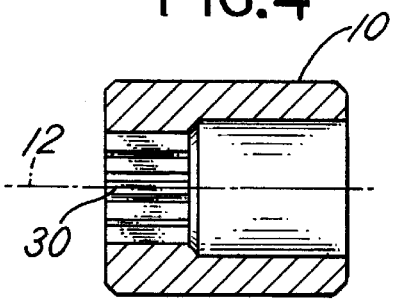
FIG. 4 is a cross sectional view of the tool of FIG. 3 taken along the line 4—4.
Figure 5:
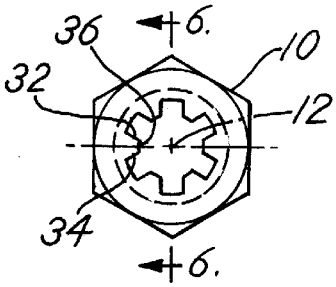
FIG. 5 is another end view of yet a further embodiment of the bolt and stud removal tool.
Figure 6:
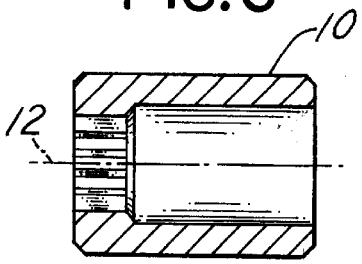
FIG. 6 is a cross sectional view of the tool of FIG. 5 taken along the line 6—6.

*$R_1$ and $R_2$ in FIG. 1A

The bolt and stud removal set of the type depicted in the Figures and described above and specified in Table 1 were the subject of a test comparing their use with some known available prior art products of a similar nature. Specifically, tools manufactured by Inshalla, under the product name Damaged Nut & Bolt Removers. A second set of tools having the product name LT (Lock Technologies) LT-4600 and made by Lock Technologies having inclined teeth. Tools as set forth in the above table were used in comparison with their associated companion size prior art tools and the results are set forth in Table 2.

TABLE 2

BOLT-STUD REMOVER TEST

| Bolt-Stud Size | Manufacturer | Results | |
|---|---|---|---|
| 7/16 (11 mm) Hex Head | Inshalla | 10 ft-lb | broke bolt |
| | LT (Lock Technologies) | 10 ft-lb | broke bolt |
| | Lisle Tool No. 4 | 10 ft-lb | broke bolt |
| ½ (13 mm) Hex Head | Inshalla | 15 ft-lb | stripped bolt head |
| | LT | 20 ft-lb | broke bolt |
| | Lisle Too No. 5 | 40 ft-lb | broke bolt |
| 9/16 (14 mm) Hex Head | Inshalla | 45 ft-lb | broke bolt |
| | LT | 50 ft-lb | broke bolt |
| | Lisle Tool No. 6 | 50 ft-lb | broke bolt |
| ¼ (6 mm) Thread | Inshalla | | too large for this thread |
| | LT | | too large for this thread |
| | Lisle Tool No. 1 | 12 ft-lb | broke bolt |
| 5/16 (8 mm) Thread | Inshalla | 8 ft-lb | stripped threads |
| | LT | | too large for this thread |
| | Lisle Tool No. 2 | 20 ft-lb | broke bolt |
| 3/8 (10 mm) Thread | Inshalla | 5 ft-lb | stripped threads |
| | LT | 45 ft-lb | stripped threads |
| | Lisle Tool No. 3 | 55 ft-lb | broke bolt |
| 7/16 (11 mm) thread | Inshalla | 15 ft-lb | stripped threads |
| | LT | 12 ft-lb | stripped threads |
| | Lisle Tool No. 4 | 120 ft-lb | stripped threads |
| ½ (13 mm) Thread | Inshalla | 50 ft-lb | stripped threads |
| | LT | 100 ft-lb | broke bolt |
| | Lisle Tool No. 5 | 100 ft-lb | broke bolt |

TABLE 2-continued

BOLT-STUD REMOVER TEST

| Bolt-Stud Size | Manufacturer | Results | |
|---|---|---|---|
| 9/16 (14 mm) Thread | Inshalla | 40 ft-lb | stripped threads |
| | LT | 100 ft-lb | stripped threads |
| | Lisle Tool No. 6 | 155 ft-lb | broke bolt |

In each instance the tool was driven onto the head of a stud or bolt under investigation. A torque wrench was then applied to the tool in order to turn the tool and in order to effect removal of the stud or bolt thereby. The resultant torque and observed results with respect to such use was then recorded. In the instance where the bolt was broken or the stud was broken, the tool was deemed useful. However, in the event that the bolt or stud was stripped, then the tool was deemed to be unacceptable for use with respect to such a bolt or stud. It is noted that in every instance, the tools of the invention were successfully used to break the bolt or stud and were successfully used at much higher torque readings. This indicates that the tools of the invention have a much broader range of application and can be utilized to provide a much higher torque to remove the bolts or studs under investigation.

As previously identified, tools incorporating the subject matter of the invention may be varied in certain features and construction. The size and positioning of the teeth, and various dimensional characteristics may be altered. The number of teeth may be altered. Also, the tool of the invention is designed in a manner which permits ease of manufacture by a broaching operation for formation of the teeth 30. Other methods of manufacture may be utilized. Thus, the invention is to be limited only by the following claims and equivalents thereof.

What is claimed is:

1. A bolt and stud removal tool comprising, in combination:

an elongate member symmetrical about a centerline axis and including an external surface and a shaped internal bore extending axially from a first end of the tool, said elongate member further including a polygonal shape on at least part of the external surface;

said member further including a bolt and stud engaging section in the bore extending from said first end of the member and a shard receiving section in the bore extending axially from the bolt and stud engaging section, said shaped external surface having a regular polygonal form for engagement by a working tool;

said shaped bore at the bolt and stud engaging section comprising at least three, equally spaced, parallel, radially inwardly projecting internal ribs formed on the interior of the bore, each of said ribs defined by first and second converging walls parallel to the centerline axis, said first and second walls defining converging planar projections and a third connecting wall also parallel to and spaced from the centerline axis and intersecting the first and second walls to define intersecting edges, the planar projections of the converging walls of each rib intersecting along a line intermediate the centerline axis and the third wall said first, second and third walls intersecting to define said edges for cutting into a bolt or stud when the tool is driven onto said bolt or stud.

2. The bolt and stud removal tool as set forth in claim 1 further comprising a throughbore in the elongate member.

3. The bolt and stud removal tool of characteristics of claim 1 in combination with a set of such tools having different dimensions.

4. The bolt and stud removal tool of claim 1 further including a counter bore at said first end of said member intersecting the first, second and third walls of the teeth to facilitate alignment of the tool on a bolt or stud.

5. The bolt and stud removal tool of claim 1 wherein said tool incorporates six equally spaced symmetrical teeth formed about the periphery of the centerline axis.

6. A bolt and stud removal tool as set forth in claim 1 wherein the shard receiving section has a diameter greater than the maximum diameter of the bolt and stud engaging section.

7. A bolt and stud removal tool as set forth in claim 1 wherein adjacent teeth define a groove therebetween and wherein the opposed walls of adjacent teeth are parallel to one another.

* * * * *